United States Patent [19]

Manska

[11] 4,106,769

[45] Aug. 15, 1978

[54] NON-REBOUNDING ARTICLE

[75] Inventor: Wayne E. Manska, Garden Grove, Calif.

[73] Assignees: Ronald R. Moody; Wayne E. Manska, Yorba Linda, Calif.

[21] Appl. No.: 738,445

[22] Filed: Nov. 3, 1976

[51] Int. Cl.[2] ..... A63B 39/00; A63B 43/00

[52] U.S. Cl. ..... 273/58 B; 273/58 J; 273/DIG. 5; 273/106 R

[58] Field of Search ..... 273/58 D, 58 E, 58 F, 273/58 K, 106 R, 58 B, 58 BA, 58 J, 223, 128 R, 128 A, 58; 206/315 B

[56] References Cited

U.S. PATENT DOCUMENTS

| | | | |
|---|---|---|---|
| 1,751,275 | 3/1930 | Gammeter | 206/315 B |
| 3,633,587 | 1/1972 | Hunt | 273/58 K |
| 3,734,498 | 5/1973 | Seiersen | 273/58 F X |
| 3,889,950 | 6/1975 | Kasraui | 273/58 D |
| 3,980,300 | 9/1976 | Hornsby | 273/58 B |

FOREIGN PATENT DOCUMENTS

| | | | |
|---|---|---|---|
| 390,690 | 4/1933 | United Kingdom | 273/58 BA |

*Primary Examiner*—George J. Marlo
*Attorney, Agent, or Firm*—Raymond L. Madsen

[57] ABSTRACT

There is disclosed a non-rebounding article having a thin walled container with a region of uniform thickness located adjacent the interior surface thereof adapted to receive a flexible material distributed therein, the container having an interior volume centrally located therein into which the flexible material is free to move upon impact of the container with an exterior object and a flexible material substantially located within the region of uniform thickness, the flexible material contacting the interior surface of the container and substantially being free to move away from an initial position adjacent the interior surface upon impact of the container with an exterior object whereby forces tending to cause the container to rebound from the impact with the exterior object are absorbed, the flexible material having a structural memory to substantially return it to the initial position adjacent the interior surface after the impact.

4 Claims, 6 Drawing Figures

NON-REBOUNDING ARTICLE

The present invention relates to non-rebounding articles and more particularly balls and spherical objects having a substantially zero coefficient of restitution.

In the field of non-rebounding articles or balls it has been the general practice to employ high energy absorbing material such as butyl rubber and the like for the construction of the articles and balls as in U.S. Pat. No. 3,515,389 issued to N. B. Wolfe. Although such energy absorbing material has served the purpose, it has not proved entirely satisfactory under all conditions of service for the reason that considerable difficulty has been experienced in obtaining a substantially zero coefficient of restitution for objects and articles made therefrom. The present invention overcomes this difficulty.

Those concerned with the development of ball-receiving and throwing devices have long recognized the need for a ball which provides a minimum of bounding and rebounding from such receiving and throwing devices. The present invention fulfills this need.

The general purpose of this invention is to provide a non-rebounding article or object which embraces all the advantages of similarly employed articles or objects and possesses none of the aforedescribed diadvantages. To attain this, the present invention contemplates a unique construction embodying a thin-walled container and flexible material therein whereby when the container strikes another object, re-bound and resilient impact are substantially avoided.

An object of the present invention is the provision of a non-rebounding article or object having a substantially zero coefficient of restitution.

Another object of the present invention is the provision of a non-rebounding spherical object having a substantially zero coefficient of restitution and which rolls freely over a smooth surface.

A further object of the present invention is the provision of a ball for use with ball-receiving and throwing devices which will smoothly roll and progress over the surface of the device and will not bounce or rebound therefrom.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 1B:
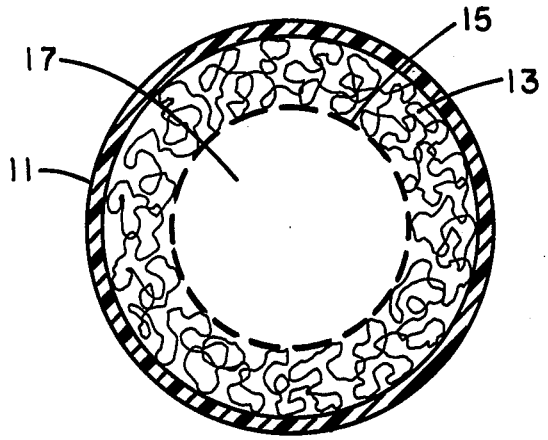
FIG. 1B shows a cross-section slice of the spherical embodiment of FIG. 1A taken between the parallel lines 1B.
Figure 1A:
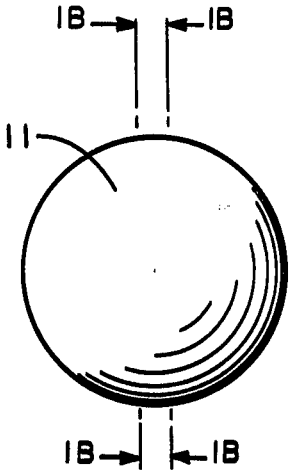
FIG. 1A shows a spherical embodiment of the invention.

Referring now to the drawings wherein like reference characters designate like or corresponding parts throughout the several views, therein shown in FIGS. 1A and 1B (which illustrate a preferred embodiment) a spherical thin-walled container or sphere 11 and a cross-section slice through the center thereof between parallel lines 1B having a solid flexible material 13 located within a region of substantially uniform thickness between dashed line 15 and the interior surface of container 11 and having an interior volume 17 centrally located in container 11 and extending to dashed line 15. Flexible material 13 may be constructed of shaved, porous, layered, segmented, laticed, filamented, or similarly arranged material which may contact the interior surface of container 11 at a plurality of points but is free to move from an initial position at rest into interior volume 17 upon impact of container 11 with an exterior hard-surfaced object. It is also possible that several of said plurality of points of a particular configuration may be permanently attached to the interior surface of container 11 to assist flexible material 13 to return to the initial position after impact. Flexible material 13 has a substantial position memory such that it has a tendency to return to the initial position adjacent the interior surface of container 11 after impact, as well. Container 11 may be constructed of plastic, wood, metal or any substantially rigid material which will contain its original shape after impact with another object.

Figure 2:
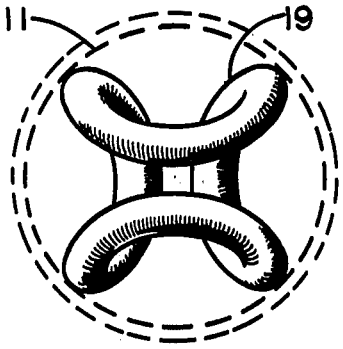
FIG. 2 illustrates a preferred embodiment of the flexible material interior to the thin-walled container of FIG. 1.

In FIG. 2 there is illustrated an elongated closed loop 19 which is folded in a geometric web-like pattern within container 11 (indicated by a dashed line) to substantially resemble a geometric pattern similar to the conventional stitching on the cover of a baseball or softball thereby maintaining the center of gravity of the folded loop coincident with the center of gravity of container 11. The closed loop is in the form of an "O" ring constructed from butyl, neoprene, vinyl or soft rubber, or the like, which may be folded into the desired geometric or web-like pattern. Other materials such as hemp, cotton or other fibrous materials woven into a rope or loop are also contemplated within the present invention.

Figure 3:
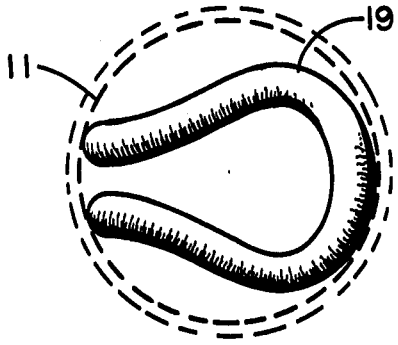
FIG. 3 shows an orthogonal view of the flexible material of FIG. 2.

FIG. 3 shows an orthogonal view of elongated loop 19 as viewed in FIG. 2 from right to left.

Figure 4A:
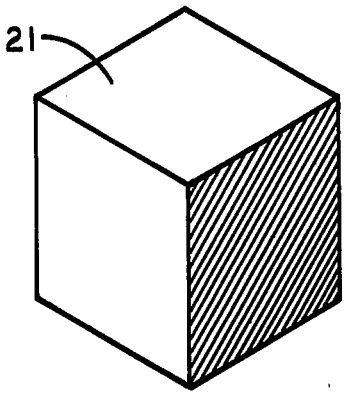
FIG. 4A shows a rectangular embodiment of the invention.

FIG. 4A, the thin-walled container is shown as a rectangular or square container 21.

Figure 4B:
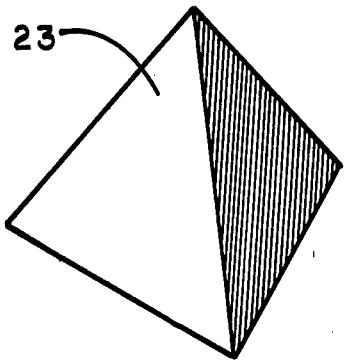
FIG. 4B shows a triangular embodiment of the invention.

FIG. 4B shows a triangular thin-walled container 23 to illustrate some of the many possible geometric shapes the container may take within the scope of the present invention.

Operation of the invention can best be understood by reference to FIGS. 1A and 1B. As container 11 collides with another object, flexible material 13 deflects from the interior surface of container 11 opposite the point of collision or impact into volume 17. Therefore, the center of gravity of material 13 shifts on impact from the center of sphere 11 toward the point of impact. Flexible material 13 and container 11 are constructed and arranged such that the rebounding force produced by the resilient material of container 11 is substantially overcome by the decelleration force of the flexible material tending to keep sphere 11 pressed against the object with which it collided or impacted.

An object having this characteristic, or having the property of not bouncing or rebounding upon impact with another object has a low coefficient of restitution. The coefficient of restitution is defined as the ratio of the diffusion in velocities between two objects after impact to the difference in velocities between two objects before impact. Consequently, a coefficient of restitution which is substantially zero indicates a substantially bounceless or non-rebounding collision and one where the difference in velicities is the same before and after collision is a perfect elastic collision. In the present invention flexible material 13 adjacent the interior surface of container 11 provides a substantially zero coefficient of restitution.

The folded elongated loop of FIGS. 2 and 3 is particularly suited to producing a low coefficient of restitution and non-rebounding ball constructed in accordance with FIGS. 1, 2 and 3 has found useful application in connection with a Device for Intercepting and Deflecting a Moving Body designed in applicant's U.S. Pat. No. 4,045,027.

It now should be apparent that the present invention provides an article of substantially zero coefficient of restitution which may be employed in conjunction with games and other applications for producing non-rebounding and bounceless collision with other objects and articles.

Although particular components, etc., have been discussed in connection with a specific embodiment of an article or object constructed in accordance with the teachings of the present invention, others may be utilized. Furthermore, it will be understood that although an exemplary embodiment of the present invention has been disclosed and discussed, other applications and mechanical arrangements are possible and that the embodiments disclosed may be subjected to various changes, modifications and substitutions, without necessarily departing from the spirit of the invention.

What is claimed is:

1. A non-rebounding article comprising, a substantially rigid thin-walled container having a region of substantially uniform thickness located adjacent the interior surface thereof adapted to receive a solid flexible material distributed therein, said container having an interior volume adjacent said region of uniform thickness and centrally located in said container, said interior volume being adapted to receive the solid flexible material from said region of substantially uniform thickness upon impact of said container with an exterior hard-surfaced object; and, an elastic web composed of solid flexible material substantially located within said region of uniform thickness, said solid flexible material contacting said exterior surface of said container and container being free to move from said region of uniform thickness and initial position adjacent said interior surface into said interior volume upon impact of said container with an exteror hard-surfaced object whereby forces tending to cause the container to rebound from an exterior hard-surfaced object upon impact are absorbed, said solid flexible material having a structural memory to substantially return it to said initial position adjacent said interior surface after impact.

2. The non-rebounding article described in claim 1 wherein said container is substantially spherical in shape.

3. The non-rebounding article described in claim 2 wherein said elastic web composed of a solid flexible is an elongated closed loop, said elongated closed loop being shaped and folded within said region of uniform thickness to form a geometric pattern therein.

4. A non-rebounding ball comprising:

a thin-walled sphere; and a flexible substantially elastic elongated loop located adjacent to the interior surface of said sphere and folded and shaped along said interior surface in a form which is substatially the same as the stitching on the covering of a baseball said elastic elongated loop having a structural memory such that said elastic elongated loop is free to move from an initial position adjacent said interior surface of said sphere upon impact of said sphere with an exterior hard-surfaced object whereby forces tending to cause said sphere to rebound from an exterior hard-surfaced object upon impact are absorbed.

* * * * *